US010570342B2

(12) United States Patent
Hanks et al.

(10) Patent No.: US 10,570,342 B2
(45) Date of Patent: Feb. 25, 2020

(54) DEASPHALTING AND HYDROPROCESSING OF STEAM CRACKER TAR

(71) Applicant: ExxonMobil Research and Engineering Company, Annandale, NJ (US)

(72) Inventors: Patrick L. Hanks, Bridgewater, NJ (US); Anjaneya S. Kovvali, Herndon, VA (US); David T. Ferrughelli, Easton, PA (US); Steven Pyl, Annandale, NJ (US); Sumathy Raman, Annandale, NJ (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 173 days.

(21) Appl. No.: 15/606,026

(22) Filed: May 26, 2017

(65) Prior Publication Data

US 2017/0362514 A1 Dec. 21, 2017

Related U.S. Application Data

(60) Provisional application No. 62/352,112, filed on Jun. 20, 2016.

(51) Int. Cl.
*C10G 21/00* (2006.01)
*C10G 21/14* (2006.01)
(Continued)

(52) U.S. Cl.
CPC ..... *C10G 21/003* (2013.01); *C10G 21/14* (2013.01); *C10G 49/002* (2013.01); *C10G 67/0454* (2013.01)

(58) Field of Classification Search
CPC .. C10G 21/003; C10G 21/14; C10G 67/0454; C10G 49/002
See application file for complete search history.

(56) References Cited

U.S. PATENT DOCUMENTS 2,408,173 A * 9/1946 Matuszak ..... C07C 7/10 585/447
3,707,459 A 12/1972 Mason et al.
(Continued)

FOREIGN PATENT DOCUMENTS

GB 1601644 A 11/1981
WO 91/17230 A1 11/1991

OTHER PUBLICATIONS

Wiehe, Irwin A. et al., "The Oil Compatibility Model and Crude Oil Incompatibility", Energy & Fuels, 2000, vol. 14, pp. 56-59.
(Continued)

*Primary Examiner* — Randy Boyer
*Assistant Examiner* — Juan C Valencia
(74) *Attorney, Agent, or Firm* — Hsin Lin

(57) ABSTRACT

Systems and methods are provided for solvent deasphalting of steam cracker tar. The resulting deasphalted oil produced from the steam cracker tar can then be hydroprocessed, such as hydrotreated and/or hydrocracked in a fixed bed reactor. The solvent deasphalting can correspond to a mild or trim deasphalting or can correspond to solvent deasphalting at higher solvent to oil ratios. Performing a trim deasphalting can reduce or minimize the amount of deasphalting residue that is formed as a product from the deasphalting process.

19 Claims, 5 Drawing Sheets

(51) Int. Cl.
*C10G 49/00* (2006.01)
*C10G 67/04* (2006.01)

(56) References Cited

U.S. PATENT DOCUMENTS

| | | | | |
|---|---|---|---|---|
| 4,446,002 | A | 5/1984 | Siegmund | |
| 5,215,649 | A | 6/1993 | Grenoble et al. | |
| 5,443,715 | A | 8/1995 | Grenoble et al. | |
| 5,871,634 | A | 2/1999 | Wiehe et al. | |
| 7,560,020 | B2 | 7/2009 | Annamalai et al. | |
| 7,846,324 | B2 | 12/2010 | Annamalai et al. | |
| 8,357,291 | B2 | 1/2013 | Sury et al. | |
| 8,709,233 | B2 | 4/2014 | McCoy et al. | |
| 2005/0261537 | A1 | 11/2005 | Stell et al. | |
| 2008/0099371 | A1* | 5/2008 | McCoy | C10G 21/003 208/86 |
| 2011/0198266 | A1* | 8/2011 | Colyar | C10G 67/049 208/86 |
| 2013/0026063 | A1* | 1/2013 | Gillis | C10G 45/00 208/44 |

OTHER PUBLICATIONS

PCT/US2017/034610 International Search Report and Written Opinion dated Aug. 7, 2017.

* cited by examiner

DEASPHALTING AND HYDROPROCESSING OF STEAM CRACKER TAR

CROSS-REFERENCE TO RELATED APPLICATIONS

This application claims priority to U.S. Provisional Application Ser. No. 62/352,112 filed Jun. 20, 2016, which is herein incorporated by reference in its entirety.

FIELD

Systems and methods are provided for processing of stream cracker tar fractions.

BACKGROUND

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace wherein the feedstock, typically comprising crude or a fraction thereof optionally desalted, is heated sufficiently to cause thermal decomposition of the larger molecules. Among the valuable and desirable products include light olefins such as ethylene, propylene, and butylenes. The pyrolysis process, however, also produces molecules that tend to combine to form high molecular weight materials known as steam cracked tar or steam cracker tar, hereinafter referred to as "SCT". These are among the least valuable products obtained from the effluent of a pyrolysis furnace. In general, feedstocks containing higher boiling materials ("heavy feeds") tend to produce greater quantities of SCT.

SCT is among the least desirable of the products of pyrolysis since it finds few uses. SCT tends to be incompatible with other "virgin" (meaning it has not undergone any hydrocarbon conversion process such as FCC or steam cracking) products of the refinery pipestill upstream from the steam cracker. At least one reason for such incompatibility is the presence of asphaltenes. Asphaltenes are high in molecular weight and can precipitate out when blended in even insignificant amounts into other materials, such as fuel oil streams.

One way to avoid production of SCT is to limit conversion of the pyrolysis feed, but this also reduces the amount of valuable products such as light olefins. Another solution is to "flux" or dilute SCT with stocks that do not contain asphaltenes, but this also requires the use of products that find higher economic value in other uses.

In U.S. Pat. No. 4,446,002, the precipitation of sediment in unconverted residuum obtained from a virgin residuum conversion process is taught to be suppressed by blending the unconverted residuum with an effective amount of a virgin residuum having an asphaltene content of at least about 8 wt % of the virgin residuum at a temperature sufficient to maintain both residuum components at a viscosity of no greater than about 100 cSt (centistokes) during blending. Virgin residuum is the bottoms product of the atmospheric distillation of petroleum crude oil at temperatures of about 357 to 385.degree. C.

In U.S. Pat. No. 5,443,715, steam cracked tar is upgraded by mixing with a "hydrogen donor", preferably hydrotreated steam cracked tar, at or downstream of quenching of the effluent of a gas oil steam cracker furnace. In this regard, see also U.S. Pat. Nos. 5,215,649; and 3,707,459; and WO 9117230.

US 2005/0261537 discloses a process for cracking a heavy hydrocarbon feedstock containing non-volatile components and/or coke precursors, wherein a stripping agent is added to the feedstock to form a blend which is thereafter separated into a vapor phase and a liquid phase by flashing in a flash/separation vessel, and subsequently cracking the vapor phase.

U.S. Pat. No. 7,560,020 describes methods for using a stripping tower to perform a separation on steam cracker tar to remove at least a portion of asphaltenes from the steam cracker tar.

SUMMARY

In an aspect, a method for processing a feedstock is provided. The method includes mixing a feedstock comprising a 550° F.+ (~288° C.+) fraction and having a hydrogen content of about 8.0 wt % or less with a paraffinic solvent. The paraffinic solvent can be mixed with the feedstock in a solvent to feedstock volume ratio of about 3.0 or less to form a mixture. The mixture can include at least a first phase comprising at least 50 vol % of the paraffinic solvent and at least 50 vol % of the feedstock, and a second phase. At least a portion of the first phase can be separated from the mixture. The at least a portion of the first phase can be further separated to form a separated fraction having a higher vol % of feedstock than the at least a portion of the first phase and having a lower vol % of asphaltenes than the feedstock. After the further separation, at least a portion of the separated fraction can optionally be hydroprocessed under hydroprocessing conditions to form a hydroprocessed effluent. For example, the hydroprocessing conditions can be sufficient for conversion of at least about 5 wt % of the at least a portion of the separated fraction relative to a conversion temperature of 700° F. (~371° C.).

In another aspect, a deasphalted oil composition is provided. The deasphalted oil composition can have a hydrogen content of about 7.5 wt % or less and/or a paraffin content of less than about 1.0 wt % paraffins and/or a naphthene content of less than about 1.0 wt % naphthenes. The deasphalted oil composition can also include at least about 40.0 wt % 3-ring aromatics and/or at least about 40 wt % 4-ring aromatics. The deasphalted oil composition can also include an asphaltene content of about 5.0 wt % or less and/or a micro carbon residue of about 5.0 wt % to about 20.0 wt %. In some optional aspects, the deasphalted oil composition can have an asphaltene content of about 1.0 wt % or less and a micro carbon residue of about 5.0 wt % to about 10.0 wt %. In other optional aspects, the deasphalted oil composition can have an asphaltene content of about 1.0 wt % to about 5.0 wt % and a micro carbon residue of about 10.0 wt % to about 20.0 wt %.

In still another aspect, a deasphalter rock composition is provided. The composition can have a hydrogen content of about 6.0 wt % or less and a carbon content of at least about 88.0 wt %. The composition can also have a micro carbon residue of at least about 46.0 wt % and/or a viscosity at 170° C. of at least about $5\times10^6$ cP (~5000 Pascal seconds), the composition being a solid at 100° C.

In yet another aspect, a system for processing a feedstock is provided. The system can include an extractor comprising two theoretical extraction stages or less, the extractor having at least one inlet for receiving feedstock and solvent, a first extractor outlet, and a second extractor outlet. The system can also include distillation stage in fluid communication with the first extractor outlet for forming a lower boiling fraction and a higher boiling fraction. The system can further include a fixed bed hydroprocessing reactor for receiving the higher boiling fraction, the fixed bed hydroprocessing reactor comprising at least one fixed bed of hydroprocessing catalyst.

DETAILED DESCRIPTION

Figure 1:
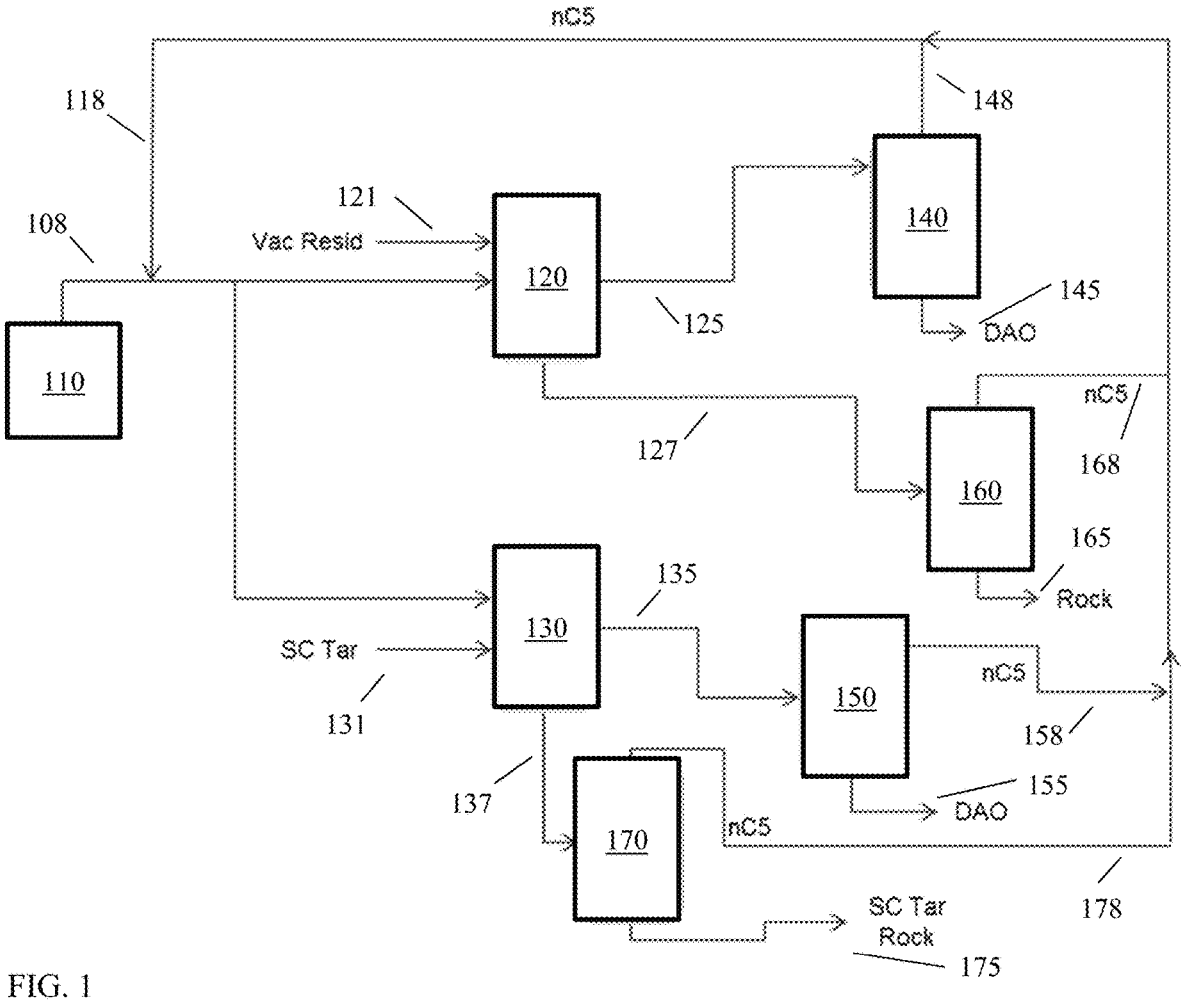
FIG. 1 schematically shows an example of an integrated system for solvent deasphalting of a steam cracker tar feed and a vacuum resid feed.

All numerical values within the detailed description and the claims herein are modified by "about" or "approximately" the indicated value, and take into account experimental error and variations that would be expected by a person having ordinary skill in the art.

Overview

In various aspects, systems and methods are provided for solvent deasphalting of steam cracker tar. The resulting deasphalted oil produced from the steam cracker tar can then be hydroprocessed, such as hydrotreated and/or hydrocracked in a fixed bed reactor. In some aspects, the solvent deasphalting can correspond to a mild or trim deasphalting using a deasphalting procedure that corresponds to the equivalent of one (or possibly up to two) theoretical separation stages. Performing a trim deasphalting can reduce or minimize the amount of deasphalting residue, sometimes referred to as rock, that is formed as a product from the deasphalting process. In other aspects, the solvent deasphalting can be performed under conditions that are more analogous to solvent deasphalting conditions for a conventional vacuum gas oil boiling range feed.

"Tar" or steam cracker tar (SCT) as used herein is also referred to in the art as "pyrolysis fuel oil". The terms can be used interchangeably herein. The tar will typically be obtained from the first fractionator downstream from a steam cracker (pyrolysis furnace) as the bottoms product of the fractionator, nominally having a boiling point of at least about 550° F.+(~288° C.+). Boiling points and/or fractional weight distillation points can be determined by, for example, ASTM D2892. Alternatively, SCT can have a T5 boiling point (temperature at which 5 wt % will boil off) of at least about 550° F. (~288° C.). The final boiling point of SCT can be dependent on the nature of the initial pyrolysis feed and/or the pyrolysis conditions, and typically can be about 1450° F. (~788° C.) or less.

SCT can have a relatively low hydrogen content compared to heavy oil fractions that are typically processed in a refinery setting. In some aspects, SCT can have a hydrogen content of about 8.0 wt % or less, about 7.5 wt % or less, or about 7.0 wt % or less, or about 6.5 wt % or less. In particular, SCT can have a hydrogen content of about 5.5 wt % to about 8.0 wt %, or about 6.0 wt % to about 7.5 wt %. Additionally or alternately, SCT can have a micro carbon residue (or alternatively Conradson Carbon Residue) of at least about 10 wt %, or at least about 15 wt %, or at least about 20 wt %, such as up to about 40 wt % or more.

SCT can also be highly aromatic in nature. The paraffin content of SCT can be about 2.0 wt % or less, or about 1.0 wt % or less, such as having substantially no paraffin content. The naphthene content of SCT can also be about 2.0 wt % or less or about 1.0 wt % or less, such as having substantially no naphthene content. In some aspects, the combined paraffin and naphthane content of SCT can be about 1.0 wt % or less. With regard to aromatics, at least about 30 wt % of SCT can correspond to 3-ring aromatics, or at least 40 wt %. In particular, the 3-ring aromatics content can be about 30 wt % to about 60 wt %, or about 40 wt % to about 55 wt %, or about 40 wt % to about 50 wt %. Additionally or alternately, at least about 30 wt % of SCT can correspond to 4-ring aromatics, or at least 40 wt %. In particular, the 4-ring aromatics content can be about 30 wt % to about 60 wt %, or about 40 wt % to about 55 wt %, or about 40 wt % to about 50 wt %. Additionally or alternately, the 1-ring aromatic content can be about 15 wt % or less, or about 10 wt % or less, or about 5 wt % or less, such as down to about 0.1 wt %.

Due to the low hydrogen content and/or highly aromatic nature of SCT, the solubility number ($S_{BN}$) and insolubility number ($I_N$) of SCT can be relatively high. SCT can have a $S_{BN}$ of at least about 100, and in particular about 120 to about 230, or about 150 to about 230, or about 180 to about 220. Additionally or alternately, SCT can have an $I_N$ of about 70 to about 180, or about 100 to about 160, or about 80 to about 140. Further additionally or alternately, the difference between $S_{BN}$ and $I_N$ for the SCT can be at least about 30, or at least about 40, or at least about 50, such as up to about 150.

SCT can also have a higher density than many types of crude or refinery fractions. In various aspects, SCT can have a density at 15° C. of about 1.08 g/cm$^3$ to about 1.20 g/cm$^3$, or 1.10 g/cm$^3$ to 1.18 g/cm$^3$. By contrast, many types of vacuum resid fractions can have a density of about 1.05 g/cm$^3$ or less. Additionally or alternately, density (or weight per volume) of the heavy hydrocarbon can be determined according to ASTM D287-92 (2006) Standard Test Method for API Gravity of Crude Petroleum and Petroleum Products (Hydrometer Method), which characterizes density in terms of API gravity. In general, the higher the API gravity, the less dense the oil. API gravity can be 5° or less, or 0° or less, such as down to about −10° or lower.

Contaminants such as nitrogen and sulfur are typically found in SCT, often in organically-bound form. Nitrogen content can range from about 50 wppm to about 10,000 wppm elemental nitrogen or more, based on total weight of the SCT. Sulfur content can range from about 0.1 wt % to about 10 wt %, based on total weight of the SCT.

As an example, SCT can be obtained as a product of a pyrolysis furnace wherein additional products include a vapor phase including ethylene, propylene, butenes, and a liquid phase comprising C5+ species, having a liquid product distilled in a primary fractionation step to yield an overheads comprising steam-cracked naphtha fraction (e.g., C5-C10 species) and steam cracked gas oil (SCGO) fraction (i.e., a boiling range of about 400 to 550° F., or ~204 to ~288° C., e.g., C10-C15/C17 species), and a bottoms fraction comprising SCT and having a boiling range above about 550° F. (~288° C.), e.g., C15/C17+ species.

SCT is traditionally a difficult fraction in a refinery setting. Conventional fixed bed processing of SCT is generally not practical for various reasons. As a standalone feed, SCT can quickly foul fixed bed processing units. Without being bound by any particular theory, this is believed to be due in part to asphaltenes within the SCT becoming insoluble during hydroprocessing, resulting in asphaltene precipitation within the fixed catalyst bed. In particular, SCT can have relatively high values for both $S_{BN}$ and $I_N$. Because $S_{BN}$ can drop substantially more rapidly than $I_N$ during hydroprocessing that results in conversion of a feed (such as conversion relative to 700° F./~371° C. or conversion relative to 1050° F./~566° C.), attempts to hydroprocess SCT in a meaningful manner can quickly result in fouling and/or plugging of fixed bed reactors. Attempting to co-process SCT with other feeds can potentially exacerbate this difficulty, as most conventional refinery feeds can have starting $S_{BN}$ values that are substantially less than SCT. Additionally, portions of an SCT feed can have a viscosity and/or other flow properties that can result in portions of an SCT feed adhering to surfaces within processing equipment, leading to further fouling. Due to these difficulties, SCT is often used as a component of a fuel oil pool, which corresponds to a relatively low value use.

Some prior efforts to improve the ability to process SCT have involved performing a boiling point based separation. However, conventional vacuum pipestill separations can be difficult to perform, as the components in SCT are susceptible to oligomerization at temperature and pressure combinations that are often used for vacuum fractionation. As an alternative, a boiling point separation can be at least partially performed using a stripping tower as a separator. Due to the viscous nature of SCT, lower boiling portions of the SCT can become entrained in the higher viscosity portions. Use of a stripping agent in a stripping tower can assist with physically separating the lower boiling portions of a SCT fraction from the higher boiling portions. In U.S. Pat. No. 7,560,020, this type of stripping-based separation is referred to as "deasphalting", even though the process is related to separation based on boiling point.

It should be noted that the terms thermal pyrolysis unit, pyrolysis unit, and steam cracker are used synonymously herein; all refer to what is conventionally known as a steam cracker, even though steam is optional.

The term "asphaltene" is well-known in the art and generally refers to the material obtainable from crude oil and having an initial boiling point above 1200° F. (i.e., 1200° F.+ or ~650° C.+ material) and which is insoluble in straight chain alkanes such as hexane and heptanes, i.e., paraffinic solvents. Asphaltenes are high molecular weight, complex aromatic ring structures and may exist as colloidal dispersions. They are soluble in aromatic solvents like xylene and toluene. Asphaltene content can be measured by various techniques known to those of skill in the art, e.g., ASTM D3279. In various aspects, SCT can have an n-heptane insoluble asphaltene content of at least about 5 wt %, or at least about 10 wt %, or at least about 15 wt %, such as up to about 40 wt %.

In general the operating conditions of such a pyrolysis furnace, which may be atypical pyrolysis furnace such as known per se in the art, can be determined by one of ordinary skill in the art in possession of the present disclosure without more than routine experimentation. Typical conditions will include a radiant outlet temperature of between 760-880° C., a cracking residence time period of 0.01 to 1 sec, and a steam dilution of 0.2 to 4.0 kg steam per kg hydrocarbon.

A method of characterizing the solubility properties of a petroleum fraction can correspond to the toluene equivalence (TE) of a fraction, based on the toluene equivalence test as described for example in U.S. Pat. No. 5,871,634, which is incorporated herein by reference with regard to the definition for toluene equivalence, solubility number ($S_{BN}$), and insolubility number ($I_N$).

Briefly, the determination of the Insolubility Number and the Solubility Blending Number for a petroleum oil containing asphaltenes requires testing the solubility of the oil in test liquid mixtures at the minimum of two volume ratios of oil to test liquid mixture. The test liquid mixtures are prepared by mixing two liquids in various proportions. One liquid is nonpolar and a solvent for the asphaltenes in the oil while the other liquid is nonpolar and a nonsolvent for the asphaltenes in the oil. Since asphaltenes are defined as being insoluble in n-heptane and soluble in toluene, it is most convenient to select the same n-heptane as the nonsolvent for the test liquid and toluene as the solvent for the test liquid. Although the selection of many other test nonsolvents and test solvents can be made, there use provides not better definition of the preferred oil blending process than the use of n-heptane and toluene described here.

A convenient volume ratio of oil to test liquid mixture is selected for the first test, for instance 1 ml. of oil to 5 ml. of test liquid mixture. Then various mixtures of the test liquid mixture are prepared by blending n-heptane and toluene in various known proportions. Each of these is mixed with the oil at the selected volume ratio of oil to test liquid mixture. Then it is determined for each of these if the asphaltenes are soluble or insoluble. Any convenient method might be used. One possibility is to observe a drop of the blend of test liquid mixture and oil between a glass slide and a glass cover slip using transmitted light with an optical microscope at a magnification of from 50 to 600×. If the asphaltenes are in solution, few, if any, dark particles will be observed. If the asphaltenes are insoluble, many dark, usually brownish, particles, usually 0.5 to 10 microns in size, will be observed. Another possible method is to put a drop of the blend of test liquid mixture and oil on a piece of filter paper and let dry. If the asphaltenes are insoluble, a dark ring or circle will be seen about the center of the yellow-brown spot made by the oil. If the asphaltenes are soluble, the color of the spot made by the oil will be relatively uniform in color. The results of blending oil with all of the test liquid mixtures are ordered according to increasing percent toluene in the test liquid mixture. The desired value will be between the minimum percent toluene that dissolves asphaltenes and the maximum percent toluene that precipitates asphaltenes. More test liquid mixtures are prepared with percent toluene in between these limits, blended with oil at the selected oil to test liquid mixture volume ratio, and determined if the asphaltenes are soluble or insoluble. The desired value will be between the minimum percent toluene that dissolves asphaltenes and the maximum percent toluene that precipitates asphaltenes. This process is continued until the desired value is determined within the desired accuracy. Finally, the desired value is taken to be the mean of the minimum percent toluene that dissolves asphaltenes and the maximum percent toluene that precipitates asphaltenes. This is the first datum point, $T_1$, at the selected oil to test liquid mixture volume ratio, $R_1$. This test is called the toluene equivalence test.

The second datum point can be determined by the same process as the first datum point, only by selecting a different oil to test liquid mixture volume ratio. Alternatively, a percent toluene below that determined for the first datum point can be selected and that test liquid mixture can be added to a known volume of oil until asphaltenes just begin to precipitate. At that point the volume ratio of oil to test liquid mixture, $R_2$, at the selected percent toluene in the test liquid mixture, $T_2$, becomes the second datum point. Since the accuracy of the final numbers increase as the further apart the second datum point is from the first datum point, the preferred test liquid mixture for determining the second datum point is 0% toluene or 100% n-heptane. This test is called the heptane dilution test.

The Insolubility Number, $I_N$, is given by:

$$I_N = T_2 - \left[\frac{T_2 - T_1}{R_2 - R_1}\right]R_2 \quad (1)$$

and the Solubility Blending Number, $S_{BN}$, is given by:

$$S_{BN} = I_N\left[1 + \frac{1}{R_2}\right] - \frac{T_2}{R_2} \quad (2)$$

It is noted that additional procedures are available, such as those specified in U.S. Pat. No. 5,871,634, for determination of $S_{BN}$ for oil samples that do not contain asphaltenes.

Solvent Deasphalting and Trim Deasphalting

SCT can represent an unconventional feed for solvent deasphalting. Traditionally, solvent deasphalting is a process that is performed on vacuum resid fractions that have a hydrogen content of at least about 9.0 wt % and/or a density of about 1.06 g/cm$^3$ or less. Often the vacuum resid is derived from fractionation of a crude oil feed that includes a portion suitable for lubricant base oil production. The vacuum resid from such crudes can have a relatively low aromatics content, such as about 15 wt % to 40 wt %.

Solvent deasphalting is a solvent extraction process. Typical solvents include alkanes or other hydrocarbons containing about 3 to about 6 carbons per molecule. Examples of suitable solvents include propane, n-butane, isobutane, and n-pentane. Alternatively, other types of solvents may also be suitable, such as virgin naphtha and/or kerosene, both of which typically have a substantial paraffin content. During solvent deasphalting, a feed portion is mixed with the solvent. Portions of the feed that are soluble in the solvent are then extracted, leaving behind a residue with little or no solubility in the solvent. Solvent deasphalting conditions include mixing a feedstock fraction with a solvent in a solvent to feedstock volume ratio of from about 4:1 to about 20:1, or about 4:1 to about 10:1. Solvent deasphalting temperatures range from about 40° C. to about 150° C. The pressure during solvent deasphalting can be from about 50 psig (345 kPag) to about 500 psig (3447 kPag).

The portion of the deasphalted feedstock that is extracted with the solvent can be referred to as deasphalted oil. The yield of deasphalted oil from a solvent deasphalting process varies depending on a variety of factors, including the nature of the feedstock, the type of solvent, and the solvent extraction conditions. A lighter molecular weight solvent such as propane will result in a lower yield of deasphalted oil as compared to n-pentane, as fewer components of the feedstock will be soluble in the shorter chain alkane. However, the deasphalted oil resulting from propane deasphalting is typically of higher quality, resulting in expanded options for use of the deasphalted oil. Under typical deasphalting conditions, increasing the temperature will also usually reduce the yield while increasing the quality of the resulting deasphalted oil. In various embodiments, the yield of deasphalted oil from solvent deasphalting of steam cracker tar can be about 40 wt % to about 65 wt % of the feed to the deasphalting process, or about 40 wt % to about 60 wt %, or about 50 wt % to about 65 wt %. The balance of the feed can form a deasphalting residue or rock. The rock from solvent deasphalting of SCT can correspond to about 35 wt % to about 60 wt % of the feedstock.

The above conditions can roughly correspond to performing a traditional type of solvent deasphalting on steam cracker tar (SCT). While the above conditions produce deasphalted oil that is suitable for further hydroprocessing, a substantial amount of rock is also formed. In other aspects, conditions corresponding to trim deasphalting can be used. Trim deasphalting can be used to remove particulate fines and/or asphaltenes from the SCT while reducing or minimizing the amount of deasphalting residue.

Trim deasphalting conditions can differ from other solvent deasphalting conditions in several ways. One difference can be a related to the amount of solvent that is used. In various aspects, the volume ratio of solvent to feedstock can be about 1.0 to about 3.0, or about 1.5 to about 3.0, or about 1.0 to about 2.0. The nature of the contacting with the solvent can also be different. In traditional solvent deasphalting, the solvent is contacted with the feedstock in an extractor that corresponds to at least 5 theoretical stages. By contrast, trim deasphalting can be performed using an extractor that corresponds to 2 theoretical stages or less, such as a single theoretical stage. An example of a suitable extractor for trim solvent deasphalting can be mixing solvent with feedstock in a settling tank, where fines and precipitated asphaltenes can settle to the bottom of the tank while a mixture of solvent and deasphalted oil exits from the tank by overflow. In some aspects, propane or butane, in particular propane, can be preferred as the solvent.

Performing trim deasphalting on SCT can allow for an increased yield of deasphalted oil and a corresponding decrease in residue or rock. The yield of DAO from trim deasphalting can be about 80 wt % to about 95 wt %, or about 85 wt % to about 95 wt %. The deasphalted oil can have a particulate fines content of about 10 wppm to about 1000 wppm, or about 25 wppm to about 250 wppm, or about 25 wppm to about 100 wppm. Additionally or alternately, the deasphalted oil can have a hydrogen content of about 6.0 wt % to about 7.5 wt %, or about 6.0 wt % to about 7.0 wt %. Additionally or alternately, the deasphalted oil can have a micro carbon residue content of about 10.0 wt % to about 20.0 wt %, or about 12.0 wt % to about 20.0 wt %, or about 10.0 wt % to about 15.0 wt %. This can correspond to a lower quality deasphalted oil than typically generated from solvent deasphalting. For comparison, deasphalting of SCT can result in a deasphalted oil having a micro carbon residue content of about 3.0 wt % to about 10.0 wt %, or about 5.0 wt % to about 10.0 wt %. However, the trim deasphalting conditions can be sufficient to reduce or minimize the amount of compounds corresponding to an $I_N$ of greater than 90. Thus, a portion of compounds normally excluded during solvent deasphalting can be retained during trim deasphalting. In various aspects, the $I_N$ of deasphalted oil produced by trim deasphalting can be about 60 to about 100, or about 60 to about 90, or about 50 to about 80. Additionally or alternately, the difference between $S_{BN}$ and $I_N$ for the trim deasphalted oil can be at least about 60, or at least about 70, or at least about 80, such as up to about 150.

The corresponding yield of deasphalting residue or rock can be about 20 wt % or less, or about 15 wt % or less, or about 10 wt % or less. The rock from trim deasphalting may be of lower quality than the rock formed from traditional solvent deasphalting. For example, the rock formed from trim deasphalting can correspond to a solid at 100° C. At 170° C., the rock can have a viscosity of at least about $5\times10^6$ cP (~5000 Pascal seconds), or at least about $1\times10^7$ cP (~10,000 Pascal seconds), such as up to $1\times10^{10}$ cP (~$1\times10^7$ Pascal seconds), which is substantially above the viscosity for a typical rock from deasphalting of a traditional feed for deasphalting. The hydrogen content of the rock can be less than about 6.0 wt %, such as 4.0 wt % to 6.0 wt %. The carbon content of the rock can be at least about 88.0 wt %, or at least about 89.0 wt %, such as up to about 92.0 wt % or more. The micro carbon residue content of the rock can be at least about 46.0 wt %, or at least about 48.0 wt %, such as up to about 60.0 wt % or more.

As an example of how trim deasphalting can work, consider a theoretical steam cracker tar feed with a $S_{BN}$ of 186 and an $I_N$ of 130. If this feed is mixed in a solvent to feed volume ratio of about 2.0 with n-heptane ($S_{BN}$=0), the resulting solvent/feed mixture can have an expected $S_{BN}$ of 62 ([186+0+0]/3=62). It is believed that this can roughly cause any compounds with an $I_N$ of greater than about 62 to precipitate out or otherwise form a separate phase from the mixture of solvent and feed. After removal of the precipitate and separation of the remaining mixture to remove solvent, the resulting trim deasphalted oil can have an $S_{BN}$ substantially above 62 while having an $I_N$ of about 62 or less. Without being bound by any particular theory, it is believed that a fraction having a $S_{BN}$ that is more than 20 greater than an $I_N$ can retain asphaltenes within the fraction without precipitation. Even though hydroprocessing of the trim deasphalted oil may cause the $S_{BN}$ to be reduced, it is believed that the $S_{BN}$ can remain at least 20 above the $I_N$, thus allowing for fixed bed processing of the trim deasphalted oil under conditions resulting in at least 5 wt % conversion of the feed relative to 1050° F. (~566° C.).

More generally, for deasphalted oil or trim deasphalted oil derived from steam cracker tar, the deasphalted oil/trim deasphalted oil can have a $S_{BN}$ of at least about 100, and in particular about 120 to about 230, or about 150 to about 230, or about 180 to about 220.

Because solvent deasphalting (such as trim deasphalting) can reduce $I_N$ for a deasphalted oil based on steam cracker tar, the deasphalted oil can also potentially be suitable for co-processing with other conventional feeds, such as vacuum gas oil feeds. This is distinct from performing solvent assisted processing. Typical solvents (such as compositions composed of or containing substantial amounts of 1-ring and/or 2-ring aromatics) can have $S_{BN}$ values of greater than 100. By contrast, a typical vacuum gas oil feed can have a $S_{BN}$ value of less than about 90, or less than about 80, or less than 70, such as down to about 40 or less. In particular, the deasphalted oil derived from steam cracker tar can be co-processed with other feeds that have a $S_{BN}$ of about 40 to about 90, or about 50 to about 90, or about 40 to about 80.

It is noted that trim deasphalting as described above is a process that involves separation of a first hydrocarbon (or hydrocarbon-like) phase from a second hydrocarbon (or hydrocarbon-like) phase. Trace amounts of water may be present in the steam cracker tar, but otherwise water is typically not introduced into the trim deasphalting environment. In particular, a continuous water phase is not present. In various aspects, the trim deasphalting environment can be substantially free of water.

Hydroprocessing of Deasphalted Oil

The deasphalted oil derived from steam cracker tar can be suitable for further hydroprocessing, such as fixed bed hydroprocessing, without requiring a co-solvent. The hydroprocessing can correspond to hydroprocessing under conditions with sufficient severity to result in at least about 2 wt % conversion relative to 700° F. (~371° C.), or at least about 5 wt % conversion, or at least about 10 wt % conversion, or at least about 20 wt % conversion. In particular, the hydroprocessing conditions can be suitable for conversion of about 2 wt % to about 35 wt % of the deasphalted oil relative to 700° F. (~371° C.), or about 5 wt % to about 30 wt %, or about 10 wt % to about 20 wt %. In many aspects, further hydroprocessing can initially correspond to hydrotreatment, although hydrocracking may also be used.

In various aspects, deasphalted oil derived from steam cracker tar can be exposed to a hydrotreating catalyst under effective hydrotreating conditions. The catalysts used can include conventional hydroprocessing catalysts, such as those comprising at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. Suitable aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. More generally, any convenient size, shape, and/or pore size distribution for a catalyst suitable for hydrotreatment of a distillate (including lubricant base oil) boiling range feed in a conventional manner may be used. Preferably, the support or carrier material is an amorphous support, such as a refractory oxide. Preferably, the support or carrier material can be free or substantially free of the presence of molecular sieve, where substantially free of molecular sieve is defined as having a content of molecular sieve of less than about 0.01 wt %.

The at least one Group VIII non-noble metal, in oxide form, can typically be present in an amount ranging from about 2 wt % to about 40 wt %, preferably from about 4 wt % to about 15 wt %. The at least one Group VI metal, in oxide form, can typically be present in an amount ranging from about 2 wt % to about 70 wt %, preferably for supported catalysts from about 6 wt % to about 40 wt % or from about 10 wt % to about 30 wt %. These weight percents are based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina, silica, silica-alumina, or titania.

The hydrotreatment is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to in this disclosure, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), and which will not adversely interfere with or affect either the reactions or the products. Impurities, such as $H_2S$ and $NH_3$ are undesirable and would typically be removed from the treat gas before it is conducted to the reactor. The treat gas stream introduced into a reaction stage will preferably contain at least about 50 vol. % and more preferably at least about 75 vol. % hydrogen.

Hydrogen can be supplied at a rate of from about 1000 SCF/B (standard cubic feet of hydrogen per barrel of feed) (~170 $Nm^3/m^3$) to about 20000 SCF/B (~3400 $Nm^3/m^3$). Preferably, the hydrogen is provided in a range of from about 2000 SCF/B (~340 $Nm^3/m^3$) to about 15000 SCF/B (~2500 $Nm^3/m^3$). Hydrogen can be supplied co-currently with the input feed to the hydrotreatment reactor and/or reaction zone or separately via a separate gas conduit to the hydrotreatment zone.

Hydrotreating conditions can include temperatures of 200° C. to 450° C., or 315° C. to 425° C.; pressures of 250 psig (1.8 MPag) to 5000 psig (34.6 MPag) or 300 psig (2.1 MPag) to 3000 psig (20.8 MPag); liquid hourly space velocities (LHSV) of 0.1 $hr^{-1}$ to 10 $hr^{-1}$; and hydrogen treat rates of 200 scf/B (35.6 $m^3/m^3$) to 10,000 scf/B (1781 $m^3/m^3$), or 500 (89 $m^3/m^3$) to 10,000 scf/B (1781 $m^3/m^3$).

As an alternative to hydrotreatment, the deasphalted oil can be exposed to a hydrocracking catalyst under effective hydrocracking conditions. The reaction conditions in the hydrocracking stage(s) in a reaction system can be selected to generate a desired level of conversion of a feed. Conversion of the feed can be defined in terms of conversion of molecules that boil above a temperature threshold to molecules below that threshold. The conversion temperature can be any convenient temperature, such as about 700° F. (371° C.).

In order to achieve a desired level of conversion, a reaction system can include at least one hydrocracking catalyst. Hydrocracking catalysts typically contain sulfided base metals on acidic supports, such as amorphous silica alumina, cracking zeolites such as USY, or acidified alumina. Often these acidic supports are mixed or bound with other metal oxides such as alumina, titania or silica. Examples of suitable acidic supports include acidic molecular sieves, such as zeolites or silicoaluminophophates. One example of suitable zeolite is USY, such as a USY zeolite with cell size of 24.30 Angstroms or less. Additionally or alternately, the catalyst can be a low acidity molecular sieve, such as a USY zeolite with a Si to Al ratio of at least about 20, and preferably at least about 40 or 50. ZSM-48, such as ZSM-48 with a $SiO_2$ to $Al_2O_3$ ratio of about 110 or less, such as about 90 or less, is another example of a potentially suitable hydrocracking catalyst. Still another option is to use a combination of USY and ZSM-48. Still other options include using one or more of zeolite Beta, ZSM-5, ZSM-35, or ZSM-23, either alone or in combination with a USY catalyst. Non-limiting examples of metals for hydrocracking catalysts include metals or combinations of metals that include at least one Group VIII metal, such as nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment).

When only one hydrogenation metal is present on a hydrocracking catalyst, the amount of that hydrogenation metal can be at least about 0.1 wt % based on the total weight of the catalyst, for example at least about 0.5 wt % or at least about 0.6 wt %. Additionally or alternately when only one hydrogenation metal is present, the amount of that hydrogenation metal can be about 5.0 wt % or less based on the total weight of the catalyst, for example about 3.5 wt % or less, about 2.5 wt % or less, about 1.5 wt % or less, about 1.0 wt % or less, about 0.9 wt % or less, about 0.75 wt % or less, or about 0.6 wt % or less. Further additionally or alternately when more than one hydrogenation metal is present, the collective amount of hydrogenation metals can be at least about 0.1 wt % based on the total weight of the catalyst, for example at least about 0.25 wt %, at least about 0.5 wt %, at least about 0.6 wt %, at least about 0.75 wt %, or at least about 1 wt %. Still further additionally or alternately when more than one hydrogenation metal is present, the collective amount of hydrogenation metals can be about 35 wt % or less based on the total weight of the catalyst, for example about 30 wt % or less, about 25 wt % or less, about 20 wt % or less, about 15 wt % or less, about 10 wt % or less, or about 5 wt % or less. In embodiments wherein the supported metal comprises a noble metal, the amount of noble metal(s) is typically less than about 2 wt %, for example less than about 1 wt %, about 0.9 wt % or less, about 0.75 wt % or less, or about 0.6 wt % or less.

A hydrocracking process can be carried out at temperatures of about 550° F. (288° C.) to about 840° F. (449° C.), hydrogen partial pressures of from about 1500 psig to about 5000 psig (10.3 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 1500 psig to about 3000 psig (10.3 MPag-20.9 MPag), and hydrogen treat gas rates of from about 213 $m^3/m^3$ to about 1068 $m^3/m^3$ (1200 SCF/B to 6000 SCF/B). The LHSV relative to only the hydrocracking catalyst can be from about 0.25 $h^{-1}$ to about 50 $h^{-1}$, such as from about 0.5 $h^{-1}$ to about 20 $h^{-1}$, and preferably from about 1.0 $h^{-1}$ to about 4.0 $h^{-1}$ In some aspects, a portion of the hydrocracking catalyst can be contained in a second reactor stage. In such aspects, a first reaction stage of the hydroprocessing reaction system can include one or more hydrotreating and/or hydrocracking catalysts. The conditions in the first reaction stage can be suitable for reducing the sulfur and/or nitrogen content of the feedstock. A separator can then be used in between the first and second stages of the reaction system to remove gas phase sulfur and nitrogen contaminants. One option for the separator is to simply perform a gas-liquid separation to remove contaminant. Another option is to use a separator such as a flash separator that can perform a separation at a higher temperature. Such a high temperature separator can be used, for example, to separate the feed into a portion boiling below a temperature cut point, such as about 350° F. (177° C.) or about 400° F. (204° C.), and a portion boiling above the temperature cut point. In this type of separation, the naphtha boiling range portion of the effluent from the first reaction stage can also be removed, thus reducing the volume of effluent that is processed in the second or other subsequent stages. Of course, any low boiling contaminants in the effluent from the first stage would also be separated into the portion boiling below the temperature cut point. If sufficient contaminant removal is performed in the first stage, the second stage can be operated as a "sweet" or low contaminant stage.

Still another option can be to use a separator between the first and second stages of the hydroprocessing reaction system that can also perform at least a partial fractionation of the effluent from the first stage. In this type of aspect, the effluent from the first hydroprocessing stage can be separated into at least a portion boiling below the distillate (such as diesel) fuel range, a portion boiling in the distillate fuel range, and a portion boiling above the distillate fuel range. The distillate fuel range can be defined based on a conventional diesel boiling range, such as having a lower end cut point temperature of at least about 350° F. (177° C.) or at least about 400° F. (204° C.) to having an upper end cut point temperature of about 700° F. (371° C.) or less or 650° F. (343° C.) or less. Optionally, the distillate fuel range can be extended to include additional kerosene, such as by selecting a lower end cut point temperature of at least about 300° F. (149° C.).

In aspects where the inter-stage separator is also used to produce a distillate fuel fraction, the portion boiling below the distillate fuel fraction includes, naphtha boiling range molecules, light ends, and contaminants such as $H_2S$. These different products can be separated from each other in any convenient manner. Similarly, one or more distillate fuel fractions can be formed, if desired, from the distillate boiling range fraction. The portion boiling above the distillate fuel range represents the potential lubricant base oils. In such aspects, the portion boiling above the distillate fuel range is subjected to further hydroprocessing in a second hydroprocessing stage.

In still another aspect, the same conditions can be used for hydrotreating and hydrocracking beds or stages, such as using hydrotreating conditions for both or using hydrocracking conditions for both. In yet another embodiment, the pressure for the hydrotreating and hydrocracking beds or stages can be the same.

Due to the viscous and/or sticky nature of some components within a deasphalted oil derived from SCT, it can be desirable to select materials for internal surfaces of an initial hydroprocessing reactor to be resistant to deposition or fouling. For example, internal surfaces of an initial hydroprocessing reactor and/or stage can be electropolished or otherwise treated to provide a surface with a reduced or minimized tendency to accumulate deposits from a feed being processed.

Configurations for Deasphalting of Steam Cracker Tar

Figure 2:
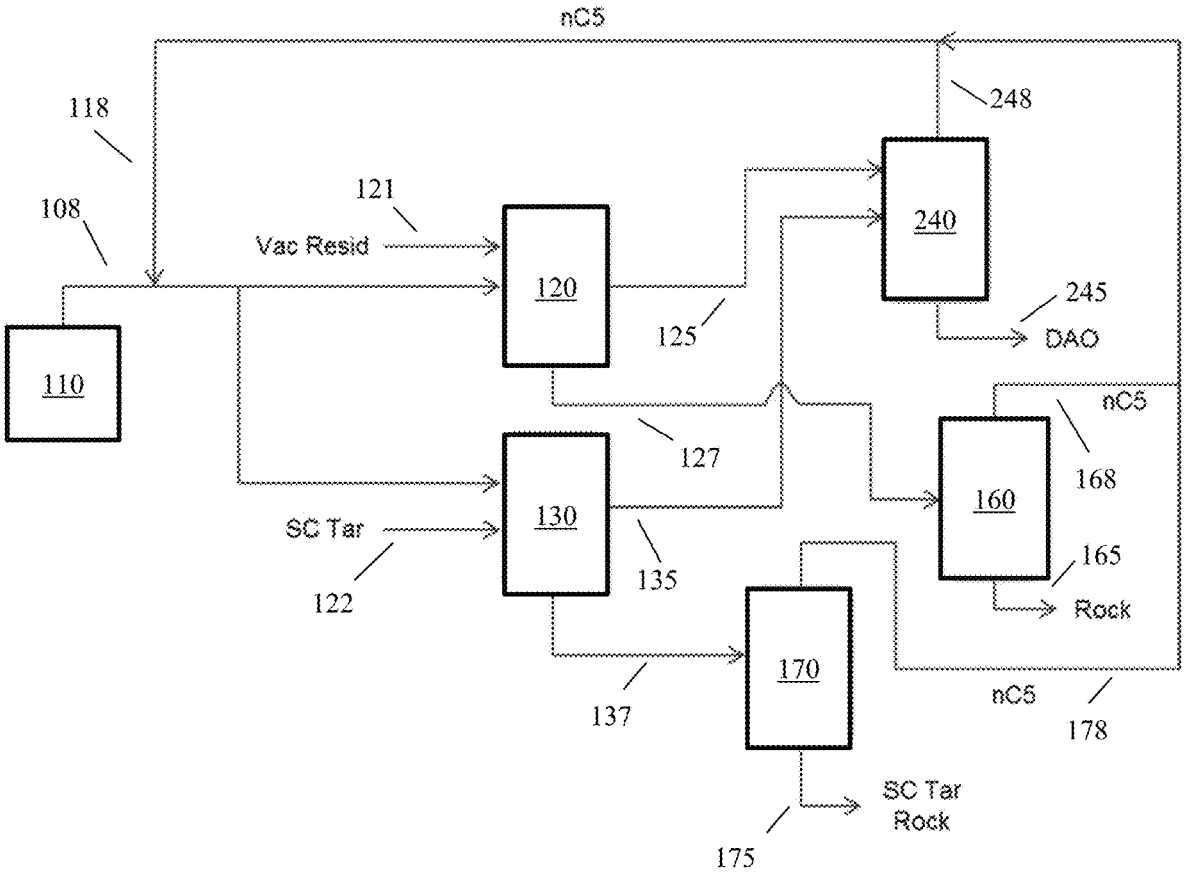
FIG. 2 schematically shows another example of an integrated system for solvent deasphalting of a steam cracker tar feed and a vacuum resid feed.
Figure 3:
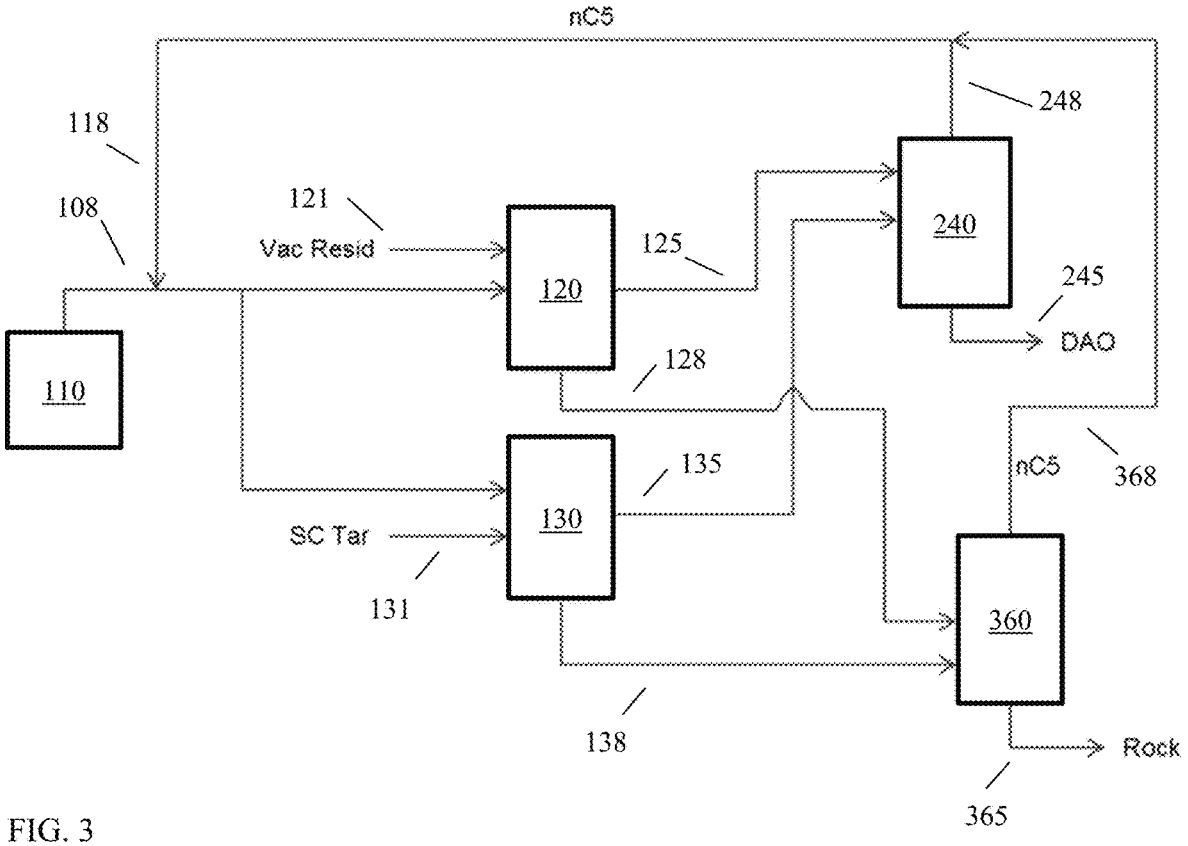
FIG. 3 schematically shows another example of an integrated system for solvent deasphalting of a steam cracker tar feed and a vacuum resid feed.

FIGS. 1 to 3 show three different potential configurations for forming a deasphalted oil having an $I_N$ of less than about 40 from steam cracker tar (SCT) and subsequently processing the deasphalted oil. The configurations in FIGS. 1 to 3 provide varying levels of integration with other refinery processes.

FIG. 1 shows an example of a configuration for performing solvent deasphalting on a steam cracker tar feed 131 and a (conventional) vacuum resid feed 121. In FIG. 1, the main type of integration between the two types of solvent deasphalting processes is in the sharing of a common recycle loop 118 for the solvent, which is shown as n-pentane ($nC_5$) in FIG. 1. A source of fresh solvent 110 can provide a stream 108 that is combined with recycled solvent 118 to supply solvent for solvent deasphalting processes 120 and 130. Solvent deasphalting process 120 corresponds to deasphalting of vacuum resid feed 121, while solvent deasphalting process 130 corresponds to deasaphalting of steam cracker tar feed 131. The deasphalting processes 120 and 130 generate separate deasphalted oil fractions, corresponding to deasphalted oil fraction 125 derived from vacuum resid and deasphalted oil fraction 135 derived from steam cracker tar. The deaphalting processes 120 and 130 also generate separate residue or rock fractions, corresponding to rock fraction 127 derived from vacuum resid and rock fraction 137 derived from steam cracker tar. Each of the fractions is then sent to a different separation process for recovery of solvent. Deasphalted oil fraction 125 is passed into separation process 140 for recovery of deasphalted oil product 145 and solvent 148. Deasphalted oil fraction 135 is passed into separation process 150 for recovery of deasphalted oil product 155 and solvent 158. Rock fraction 127 is passed into separation process 160 for recovery of rock product 165 and solvent 168. Rock fraction 137 is passed into separation process 170 for recovery of rock product 175 and solvent 178. Recovered solvents 148, 158, 168, and 178 can be optionally but preferably combined into recycle loop 118 for use in additional solvent deasphalting. Each of the products can undergo separate further processing as appropriate. For example, deasphalted oil 145 can be further hydroprocessed to form lubricant and/or fuel products. Deasphalted oil 155 can be further hydroprocessed to form fuel products. Rock fraction 165 can be handled according to typical methods for processing rock, such as incorporation into some grades of asphalt, use as a solid fuel, or any other convenient option. Rock fraction 175 can be handled in a similar manner to rock fraction 165.

FIG. 2 shows another configuration for solvent deasphalting of steam cracker tar that involves additional integration with solvent deasphalting of a vacuum resid feed. In FIG. 2, both deasphalted oil fraction 125 and deasphalted oil fraction 135 are introduced into the same separation process 240. This results in formation of a common deasphalted oil product 245, along with recovered solvent 248. Although deasphalted oil 245 may be lower in quality than a deasphalted oil derived only from vacuum resid feed 121, deasphalted oil 245 can still be suitable for further hydroprocessing to form lubricant and/or fuel products.

FIG. 3 shows another configuration for solvent deasphalting of steam cracker tar that provides still further integration with solvent deasphalting of a vacuum resid feed. In addition to having a common separation process 240 for recovery of deasphalted oil product 245, FIG. 3 also includes a common separation process 360 for recovery of rock product 365, along with recovered solvent 368. Thus, FIG. 3 corresponds to forming both a single deasphalted oil product 245 and a single rock product 365 from the solvent deasphalting of steam cracker tar feed 131 and vacuum resid feed 121.

Figure 4:
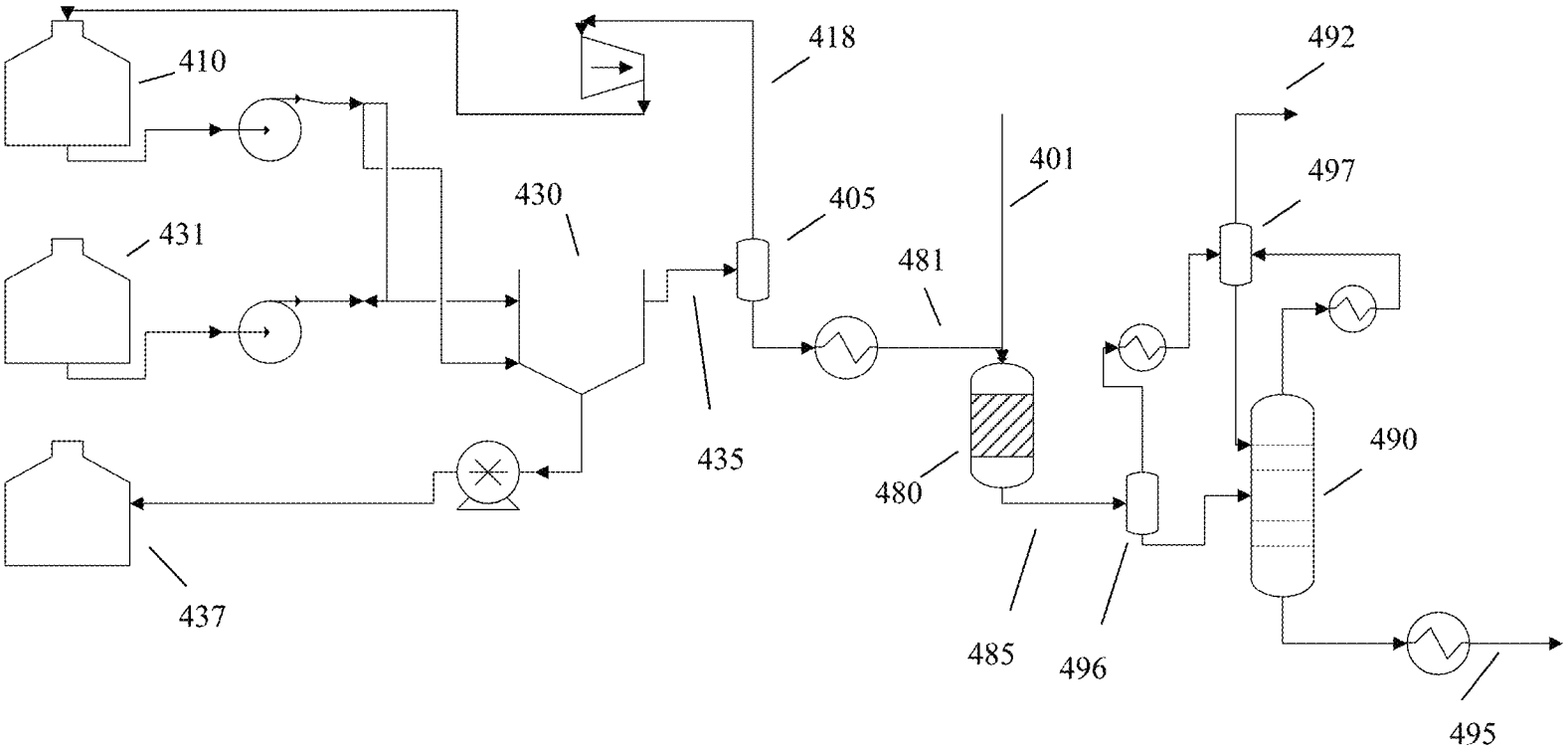
FIG. 4 schematically shows an example of a system for trim deasphalting and hydroprocessing of a steam cracker tar feed.

FIG. 4 shows a configuration for performing trim deasphalting on a steam cracker tar feed. In the configuration shown in FIG. 4, propane 410 is used as the deasphalting solvent, although the other solvents previously described could also be used. Solvent 410 is combined with steam cracker tar feed 431 and introduced into trim deasphalting vessel 430. Trim deasphalting vessel 430 is represented as a settling tank in FIG. 4, but any other convenient extractor vessel corresponding to a single theoretical stage (or optionally up to two theoretical stages) could also be used. Trim deasphalting vessel 430 produces a trim deasphalted oil plus solvent fraction 435 and a precipitated or solids fraction 437. Solids fraction 437 roughly corresponds to a rock fraction in traditional solvent deasphalting, but may have lower value than a typical rock fraction due to the more limited nature of the solids present in solids fraction 437. Solids fraction 437 can, for example, be pelletized for use as a solid fuel. Trim deasphalted oil plus solvent fraction 435 can be separated 405 to form a solvent recycle stream 418 and a trim deasphalted oil product 481. The trim deasphalted oil product 481 can then be hydroprocessed in a fixed bed hydroprocessing reactor 480, such as a fixed bed hydrotreater. Hydrogen 401 can also be introduced into hydroprocessing reactor 480. The hydroprocessing effluent 485 can be separated in a separation stage (such as, for example, one or more gas-liquid or flash type separators 496 and 497 and/or one or more fractionators 490) to produce at least a hydroprocessed liquid product 495 and a light ends product 492. Hydroprocessed liquid product 495 refers to a product that is liquid at 20° C. and about 100 kPa of pressure. Hydroprocessed liquid product 495 corresponds to a product that can be suitable for further processing in conventional refinery processes and/or suitable for incorporation in conventional refinery product pools.

ADDITIONAL EMBODIMENTS

Embodiment 1

A method for processing a feedstock, comprising: mixing a feedstock comprising a 550° F.+ (~288° C.+) fraction and having a hydrogen content of about 8.0 wt % or less (or 7.5 wt % or less, or 7.0 wt % or less) with a paraffinic solvent in a solvent to feedstock volume ratio of about 3.0 or less (or about 2.0 or less, or about 1.5 or less) to form a mixture comprising at least a first phase comprising at least 50 vol % of the paraffinic solvent and at least 50 vol % of the feedstock, and a second phase; separating at least a portion of the first phase from the mixture; and separating the at least a portion of the first phase to form a separated fraction having a higher vol % of feedstock than the at least a portion of the first phase and having a lower vol % of asphaltenes than the feedstock.

Embodiment 2

The method of Embodiment 1, further comprising hydroprocessing at least a portion of the separated fraction under hydroprocessing conditions to form a hydroprocessed effluent, the hydroprocessing conditions being sufficient for conversion of at least about 5 wt % of the at least a portion of the separated fraction relative to a conversion temperature of 700° F. (~371° C.), the hydroprocessing optionally comprising hydrotreating, hydrocracking, or a combination thereof, the hydroprocessing optionally comprising fixed bed hydroprocessing.

Embodiment 3

The method of Embodiment 2, wherein the hydroprocessing further comprises co-processing of a second feedstock having a $S_{BN}$ of about 80 or less.

Embodiment 4

The method of any of the above embodiments, wherein separating at least a portion of the first phase from the mixture comprises separating the at least a portion of the first phase from the mixture using an extractor having the equivalent of two theoretical stages or less.

Embodiment 5

The method of any of the above embodiments, wherein the second phase is immiscible in the first phase, wherein the second phase is substantially free of water, or a combination thereof.

Embodiment 6

The method of any of the above embodiments, wherein the feedstock has a micro carbon residue of about 10 wt % to about 40 wt %, or about 15 wt % to about 40 wt %; or wherein the feedstock has a solubility number of at least about 100, or at least about 120, or at least about 140; or a combination thereof.

Embodiment 7

The method of any of the above embodiments, wherein the feedstock has an insolubility number of at least about 70, or at least about 80, or at least about 100, the insolubility number of the feedstock optionally being lower than a solubility number of the feedstock by at least about 40, or at least about 50.

Embodiment 8

The method of any of the above embodiments, wherein the separated fraction has a solubility number of at least about 100, or at least about 120, or at least about 140, the separated fraction optionally having an insolubility number of about 60 to about 100, or about 60 to about 90, or about 50 to about 80.

Embodiment 9

The method of Embodiment 8, wherein the insolubility number of the separated fraction is lower than a solubility number of the separated fraction by at least about 60, or at least about 70.

Embodiment 10

A separated fraction formed according to the method of any of Embodiments 1-9.

Embodiment 11

A deasphalted oil composition having a hydrogen content of about 7.5 wt % or less (or about 7.0 wt % or less), the deasphalted oil comprising less than about 1.0 wt % paraffins, less than about 1.0 wt % naphthenes, at least about 40.0 wt % 3-ring aromatics, at least about 40 wt % 4-ring aromatics, an asphaltene content of about 5.0 wt % or less, and a micro carbon residue of about 5.0 wt % to about 20.0 wt %.

Embodiment 12

The deasphalted oil composition of Embodiment 11, wherein the deasphalted oil composition has an asphaltene content of about 1.0 wt % or less and a micro carbon residue of about 5.0 wt % to about 10.0 wt %, or wherein the deasphalted oil composition has an asphaltene content of about 1.0 wt % to about 5.0 wt % and a micro carbon residue of about 10.0 wt % to about 20.0 wt %.

Embodiment 13

A composition having a hydrogen content of about 6.0 wt % or less, a carbon content of at least about 88.0 wt %, a micro carbon residue of at least about 46.0 wt %, and a viscosity at 170° C. of at least about $5\times10^6$ cP (~5000 Pascal seconds), the composition being a solid at 100° C., the composition optionally comprising a second phase formed according to any of Embodiments 1-9.

Embodiment 14

A system for processing a feedstock, comprising: an extractor comprising two theoretical extraction stages or less, the extractor having at least one inlet for receiving feedstock and solvent, a first extractor outlet, and a second extractor outlet; a distillation stage in fluid communication with the first extractor outlet for forming a lower boiling fraction and a higher boiling fraction; and a fixed bed hydroprocessing reactor for receiving the higher boiling fraction, the fixed bed hydroprocessing reactor comprising at least one fixed bed of hydroprocessing catalyst.

Embodiment 15

The system of Embodiment 14, wherein the extractor comprises a settling tank, the first extractor outlet comprising an opening for overflow from the settling tank, or wherein the distillation stage comprises a flash separator, or a combination thereof.

Embodiment 16

The method of any of Embodiments 1-9, wherein the separated fraction comprises about 1000 wppm or less of particulate fines, or about 250 wppm or less.

Embodiment 17

The method of any of Embodiments 1-9 or 16, wherein the paraffinic solvent comprises virgin naphtha, virgin kerosene, or a combination thereof.

Embodiment 18

The composition of Embodiment 13, wherein the composition has a micro carbon reside of at least about 48.0 wt %, or wherein the composition has a carbon content of at least about 89.0 wt %, or wherein the composition has a viscosity at 170° C. of at least about $1\times10^7$ cP (~10,000 Pascal seconds), or a combination thereof.

Example: Deasphalting of Steam Cracker Tar

Steam cracker tar was formed by pyrolysis of a heavy oil feed. The pyrolysis product was separated at a temperature of about 648° F. (~342° C.) to form a gas oil fraction and a bottoms fraction, with the bottoms fraction corresponding to the steam cracker tar. The steam cracker tar had a particulate fines content of about 3000 wppm and a micro carbon residue content (MCRT test) of about 18.4 wt %. The micro carbon residue content is believed to be roughly the same as the Conradson carbon content of a sample. The hydrogen content of the steam cracker tar was about 6.1 wt %.

The steam cracker tar was deasphalted using a solvent to feed volume ratio of about 20:1, with n-pentane as the deasphalting solvent. The deasphalting vessel was a lab scale vessel that provided the equivalent of at least 5 theoretical extraction stages. The deasphalting process resulted in formation of roughly 50 wt % deasphalted oil and 50 wt % rock.

Figure 5:
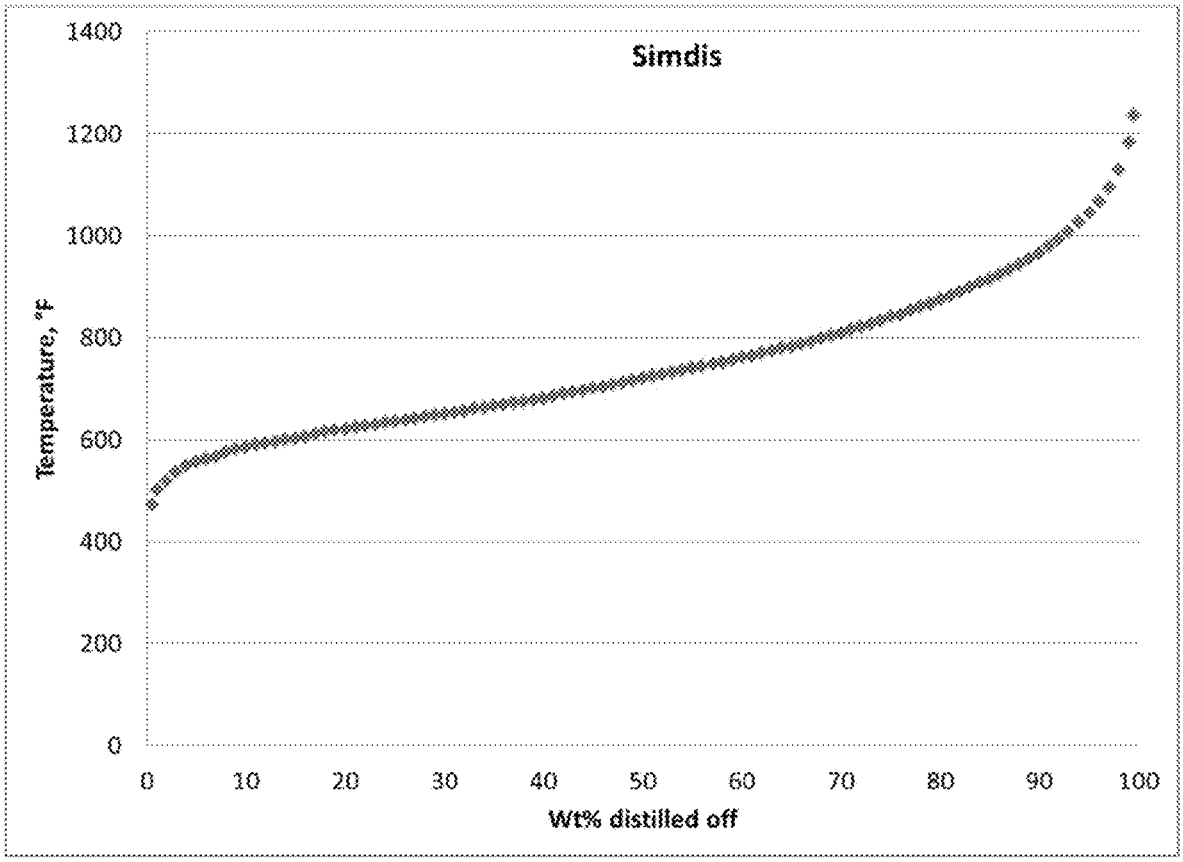
FIG. 5 shows a distillation profile for a deasphalted oil derived from a steam cracker tar feed.

The deasphalted oil had a micro carbon residue of about 8.6 wt % and a hydrogen content of about 6.5 wt %. The deasphalted oil had a kinematic viscosity at 100° C. of about 11 $mm^2/s$ (i.e., cSt), a viscosity index of about −318, and a density at 15° C. of about 1.13 $g/cm^3$. The deasphalted oil had a $S_{BN}$ of greater than about 110 and an $I_N$ of about 0. The composition of the deasphalted oil included about 0.05 wt % or less of paraffins and/or naphthenes. The deasphalted oil included at least about 40 wt % of 3-ring aromatics and at least about 40 wt % of 4-ring aromatics. FIG. 5 shows a distillation curve of the deasphalted oil after removal of the deasphalting solvent.

The rock from deasphalting had a micro carbon residue of about 48 wt % and a hydrogen content of about 5.7 wt %. The viscosity of the rock at 170° C. was at the extreme limit of the measurement technique, corresponding to a measured value of about $10^7$ centipoise.

Example 2—Co-Processing of Deasphalted Oil from Steam Cracker Tar

An empirical model based on pilot scale and production scale data was used to model co-processing of a conventional feed with a deasphalted oil formed from steam cracker tar by deasphalting at a solvent to feed ratio of greater than about 3.0 to 1. The composition of the deasphalted oil formed from steam cracker tar was modeled based on fitting the properties of a deasphalted oil to components represented within the model, as opposed to strictly attempting to represent the components in steam cracker tar in the model.

A first model feed was developed that corresponded to ~65 wt % of a conventional C5 deasphalted oil (i.e., formed from deasphalting of a conventional resid), ~10 wt % of a medium vacuum gas oil, and ~25 wt % of a heavy vacuum gas oil. A second model feed was developed by incorporating sufficient steam cracker tar (SCT) deasphalted oil so that the SCT deasphalted oil was about 6 wt % of the model composition. A third model feed was developed by incorporating sufficient SCT deasphalted oil to account for about 11 wt % of the model composition.

Processing of the three feeds was then modeled in a reaction configuration corresponding to first demetallizing the feed followed by severe hydrotreating. The demetallization and hydrotreatment processes were modeled at temperatures of about 380° C. to about 415° C. and at a hydrogen partial pressure of about 15.5 MPag. The modeled conditions resulted in conversion of about 35 wt % to about 55 wt % of the feedstock, depending on the feed and the temperature.

Based on the modeled processes, incorporation of SCT deasphalted oil had a modest quantitative impact on the resulting hydrotreating effluent but did not appear to cause notable qualitative changes in the hydrotreating effluent. Due to the low hydrogen content of SCT deasphalted oil, the feed containing 6 wt % of SCT deasphalted oil consumed about 15 vol % more hydrogen during hydroprocessing, while the feed containing 11 wt % SCT deasphalted oil consumed about 30 vol % more hydrogen. Although SCT deasphalted oil has lower hydrogen content than conventional feeds, the molecular weight distribution is not necessarily higher than other types of feeds. As a result, based on the modeling, including SCT deasphalted oil in the feed for hydroprocessing appears to result in primarily additional production of distillate boiling range products, with some additional naphtha production. The resulting distillate and lubricant boiling range products had slightly higher aromatic contents (on order of 1 wt % or less aromatics increase per 5 wt % SCT deasphalted oil in feed). The cetane number of the resulting distillate products was reduced by about 2% at each modeled condition, but still resulted in cetane numbers greater than 50 for all products. The resulting lubricant boiling range products had similar distillation profiles with or without included SCT deasphalted oil in the feedstock, and the micro carbon residue in the lubricant boiling range products did not appear to change based on inclusion of SCT deasphalted oil in the feedstock.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

The invention claimed is:

1. A method for processing a feedstock, comprising:

mixing a feedstock comprising a 550° F.+(~288° C.+) fraction and having a hydrogen content of about 8.0 wt % or less with a paraffinic solvent in a solvent to feedstock volume ratio of 3.0 or less to form a mixture comprising at least a first phase comprising at least 50 vol % of the paraffinic solvent and at least 50 vol % of the feedstock, and a second phase;

separating at least a portion of the first phase from the mixture;

separating the at least a portion of the first phase to form a separated fraction having a higher vol % of feedstock than the at least a portion of the first phase and having a lower vol % of asphaltenes than the feedstock; and hydroprocessing at least a portion of the separated fraction under hydroprocessing conditions to form a hydroprocessed effluent, the hydroprocessing comprising exposing the at least a portion of the separated fraction to a fixed bed of hydrotreating catalyst under hydrotreating conditions, the hydroprocessing conditions being sufficient for conversion of at least about 5 wt % of the at least a portion of the separated fraction relative to a conversion temperature of 700° F. (~371° C.).

2. The method of claim 1, wherein the hydroprocessing further comprises co-processing of a second feedstock having a $S_{BN}$ of about 80 or less.

3. The method of claim 1, wherein separating at least a portion of the first phase from the mixture comprises separating the at least a portion of the first phase from the mixture using an extractor having the equivalent of two theoretical stages or less.

4. The method of claim 1, wherein the second phase is immiscible in the first phase.

5. The method of claim 1, wherein the separated fraction comprises 250 wppm or less of particulate fines.

6. The method of claim 1, wherein the feedstock has a micro carbon residue of about 10 wt % to about 40 wt %.

7. The method of claim 1, wherein the feedstock has a solubility number of at least about 100.

8. The method of claim 1, wherein the feedstock has an insolubility number of at least about 80.

9. The method of claim 8, wherein the insolubility number of the feedstock is lower than a solubility number of the feedstock by at least about 40.

10. The method of claim 1, wherein the separated fraction has a solubility number of at least about 100.

11. The method of claim 10, wherein the separated fraction has an insolubility number of about 60 to about 100.

12. The method of claim 10, wherein the insolubility number of the separated fraction is lower than a solubility number of the separated fraction by at least about 60.

13. A method for processing a feedstock, comprising:

mixing a feedstock comprising a 550° F.+(~288° C.+) fraction and having a hydrogen content of about 8.0 wt % or less with a paraffinic solvent in a solvent to feedstock volume ratio of 3.0 or less to form a mixture comprising at least a first phase comprising at least 50 vol % of the paraffinic solvent and at least 50 vol % of the feedstock, and a second phase;

separating at least a portion of the first phase from the mixture;

separating the at least a portion of the first phase to form a separated fraction having a higher vol % of feedstock than the at least a portion of the first phase and having a lower vol % of asphaltenes than the feedstock; and hydroprocessing at least a portion of the separated fraction under hydroprocessing conditions to form a hydroprocessed effluent, the hydroprocessing comprising co-processing of a second feedstock having a solubility number ($S_{BN}$) of about 80 or less, the hydroprocessing conditions being sufficient for conversion of at least about 5 wt % of the at least a portion of the separated fraction relative to a conversion temperature of 700° F. (~371° C.).

14. The method of claim 13, wherein separating at least a portion of the first phase from the mixture comprises separating the at least a portion of the first phase from the mixture using an extractor having the equivalent of two theoretical stages or less.

15. The method of claim 13, wherein the separated fraction comprises 250 wppm or less of particulate fines, or wherein the feedstock has a micro carbon residue of about 10 wt % to about 40 wt %, or a combination thereof.

16. The method of claim 13, wherein the feedstock has a solubility number of at least about 100.

17. The method of claim 13, wherein the feedstock has an insolubility number of at least about 80, or wherein the insolubility number of the feedstock is lower than a solubility number of the feedstock by at least about 40, or a combination thereof.

18. The method of claim 13, wherein the separated fraction has a solubility number of at least about 100.

19. The method of claim 18, wherein the separated fraction has an insolubility number of about 60 to about 100, or wherein the insolubility number of the separated fraction is lower than a solubility number of the separated fraction by at least about 60, or a combination thereof.

* * * * *